US007207560B2

(12) United States Patent
Enenkel

(10) Patent No.: US 7,207,560 B2
(45) Date of Patent: Apr. 24, 2007

(54) PILE COMPARTMENT FOR FLAT POSTAL ARTICLES

(75) Inventor: Peter Enenkel, Constance (DE)

(73) Assignee: Siemens AG, München (DE)

( * ) Notice: Subject to any disclaimer, the term of this patent is extended or adjusted under 35 U.S.C. 154(b) by 179 days.

(21) Appl. No.: 10/516,543

(22) PCT Filed: May 12, 2003

(86) PCT No.: PCT/DE03/01528

§ 371 (c)(1),
(2), (4) Date: May 16, 2005

(87) PCT Pub. No.: WO03/104123

PCT Pub. Date: Dec. 18, 2003

(65) Prior Publication Data

US 2005/0218042 A1 Oct. 6, 2005

(30) Foreign Application Priority Data

Jun. 10, 2002 (DE) ..... 102 25 473

(51) Int. Cl.
*B65H 31/06* (2006.01)

(52) U.S. Cl. ..... 271/215; 271/214; 271/2

(58) Field of Classification Search ..... 271/213, 271/214, 215, 216, 146, 2
See application file for complete search history.

(56) References Cited

U.S. PATENT DOCUMENTS 5,871,209 A * 2/1999 Orchard et al. ..... 271/149
5,993,132 A * 11/1999 Harres et al. ..... 414/416.04

FOREIGN PATENT DOCUMENTS

| | | | |
|---|---|---|---|
| GB | 1303135 | | 1/1973 |
| JP | 02106523 A | * | 4/1990 |
| JP | 09086771 A | | 3/1997 |

OTHER PUBLICATIONS

Derwent Abstract—JP-09086771A; Mar. 31, 1997; Toshiba Corporation, Japan.

* cited by examiner

*Primary Examiner*—Patrick Mackey
*Assistant Examiner*—Kaitlin Joerger
(74) *Attorney, Agent, or Firm*—John Musone

(57) ABSTRACT

The invention relates to a pile compartment for flat postal articles placed in an upright position, comprising a pile compartment bottom (7) and a pile compartment wall (6) perpendicular thereto. The postal articles (1) inside the pile compartment (5) rest against said pile compartment wall. The pile compartment also comprises a pile support (8), which holds the pile (11) and can be displaced along the pile compartment wall (6) in an approximately horizontal piling direction. At the end of the pile compartment (5), the pile support (8) can be lowered into the plane of the pile compartment bottom, and the pile compartment bottom (7) is provided, at least in part, with a profiled design. The pile support (8) is designed so that it meshes with the bottom profile via the pile support surface that, when raised, slides on the pile compartment bottom (7).

6 Claims, 5 Drawing Sheets

PILE COMPARTMENT FOR FLAT POSTAL ARTICLES

The invention relates to a pile compartment for flat postal articles, according to the preamble of claim 1.

Sorting systems for flat postal articles having appropriate pile compartments in which the postal articles are sorted are at present still often emptied manually, that is to say the sorted piles of postal articles are transferred by hand from the sorting system into mail containers. The postal articles are in each case led into the pile compartments by a piling mechanism.

Arranged in the pile compartment is a linearly guided pile support, which guides the end of the pile and prevents the pile tipping over. For the purpose of manual emptying, this pile support is pivoted rotationally upward out of the pile and lowered into the pile again further forward, close to or at the piling point. In this case, it has both a supporting and a separating function (separating blade). The part separated in this way can then be removed manually from the pile compartment. Here, only quantities or else part lengths that can be handled easily can be removed and transferred into delivery containers. Depending on the dexterity of the operating staff, one or more accesses are therefore required to the compartment, together with the operating time associated with this.

Modern letter sorting systems currently already reach average peak throughputs of up to 45 000 postal articles per hour (200 mm long postal articles). Future high-end sorters will have still higher throughputs. Emptying the pile compartments thus either requires more operating staff (uneconomic) in the case of manual operation or, in automated operation, semiautomatic or fully automatic auxiliary apparatus for the emptying into the transport containers.

Partly or fully automated systems need adaptations of the pile compartments designed for purely manual emptying. The pile supports (separating blades) previously used and capable of being pivoted upwards, with their simple geometry, have the critical disadvantage that, as the supports are pivoted out, they pull postal articles out of the stack on account of the friction between support and pile of postal articles, and thus lead to functional disruptions. A fully automated process which completes the same function is thus highly susceptible to disruptions.

In JP 09-086 771 A a pile compartment for flat postal articles is described which has

- a pile bottom and a pile wall perpendicular thereto, on which the postal articles rest in the pile compartment,
- a pile support which can be displaced in an approximately horizontal piling direction along the pile wall and holds the pile, and
- a slot in the pile bottom with a projection from the pile support that engages therein.

Furthermore, GB patent 1 303 135 discloses a piling device for flat objects to be piled on edge, in which the pile support can be lowered downward into the plane of the pile bottom.

When these piling devices are emptied into a subsequent holder by displacing the pile, it is not ensured that individual postal articles slip downward at the end of the piling devices.

The invention is based on the object of providing a pile compartment having a part support for piles of flat postal articles in an upright position in which, during the emptying and the displacement of the pile, no postal articles are removed from the composite pile.

According to the invention, the object is achieved by a pile compartment having the features as claimed in claim 1.

The pile support is designed such that it can be lowered downward into the plane of the pile bottom at the end of the pile compartment. The pile bottom is at least partly profiled and the pile support is designed such that it meshes with the bottom profile via its surface which slides on the pile bottom and, in its raised state, prevents the pile falling over. As a result, no postal article is carried along upward, and thin postal articles cannot slip between pile support and pile bottom during displacement, because of the toothing.

Advantageous refinements of the invention are illustrated in the subclaims.

The action of lowering the pile support can be carried out in various advantageous ways.

For example, the pile support can be designed such that it can be lowered downward into the plane of the pile bottom at the end of the pile compartment in the piling direction. Then, in the pivoted-down state, the pile support performs the function of the pile bottom in relation to bridging, in order that the pile can be pushed onto a following supporting surface without interruption. For this purpose, another supporting mechanism, which is moved down from above but which is not a subject of the invention, performs the task of the pile support.

It is also advantageous if the pile support can be moved vertically at the end of the pile bottom and, at its upper edge, has a part which is aligned approximately parallel to the pile bottom when it is moved down, in order to bridge the gap between the pile bottom and a following supporting surface. In this case, the terminating edge of the pile bottom in the piling direction is also profiled, and that surface of the pile support which faces the profiled terminating edge of the pile bottom as it is moved vertically is profiled in such a way that it meshes with the profiled edge of the pile bottom when moved downward. As a result of this intermeshing profiling, no postal article can slip between pile bottom and pile support.

The vertical movement of the pile support can advantageously be implemented by pivoting the pile support in the plane of the pile bottom, perpendicularly with respect to the piling direction. In order to prevent the postal articles slipping away from the pile wall, the pile bottom advantageously has a sawtooth profile, the steep flanks being oriented toward the pile wall. As a result, the postal articles remain caught on the steep flanks.

It is also advantageous if the surface of that part of the pile support which is aligned approximately parallel to the pile base when pivoted down has the same surface profile as the pile base.

In the following text, the invention will be explained in more detail in an exemplary embodiment, using the drawing, in which.

Figure 1:
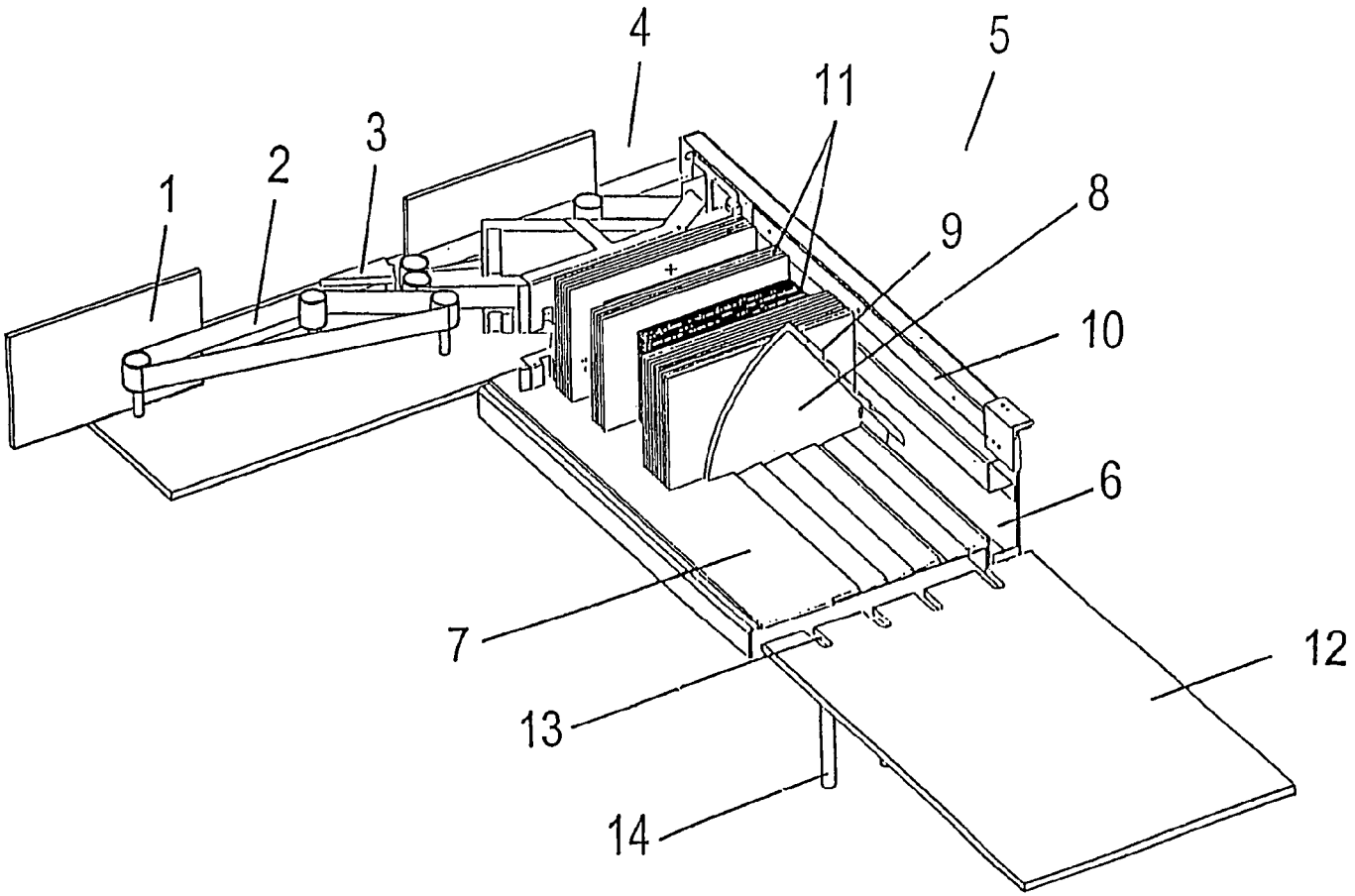
FIG. 1 shows a perspective illustration of a pile compartment with a pile of postal articles held by a pivotable pile support.

According to FIG. 1, the postal articles 1 are transported one after another in an upright position in a covering belt system, clamped in between transport belts 2, along pile compartments 5 located beside one another and belonging to a sorting machine. Each pile compartment 5 comprises a pile bottom 7 and a pile wall 6 perpendicular thereto. Before each pile compartment 5 there is a diverter arrangement having a diverter flipper 3 in order to remove postal articles specifically in accordance with the destination addresses. By means of a piling device 4 known per se, which will not be explained specifically here, the postal articles 1 are led into the respective pile compartment 5 onto a pile support 8 or onto the last postal article of a pile 11 already present. There, they are braked and aligned on the pile wall 6. The pile support 8 is designed such that it can be displaced along the pile wall 6 counter to a spring force oriented toward the piling point and can be pivoted into the plane of the pile bottom.

Figure 4:
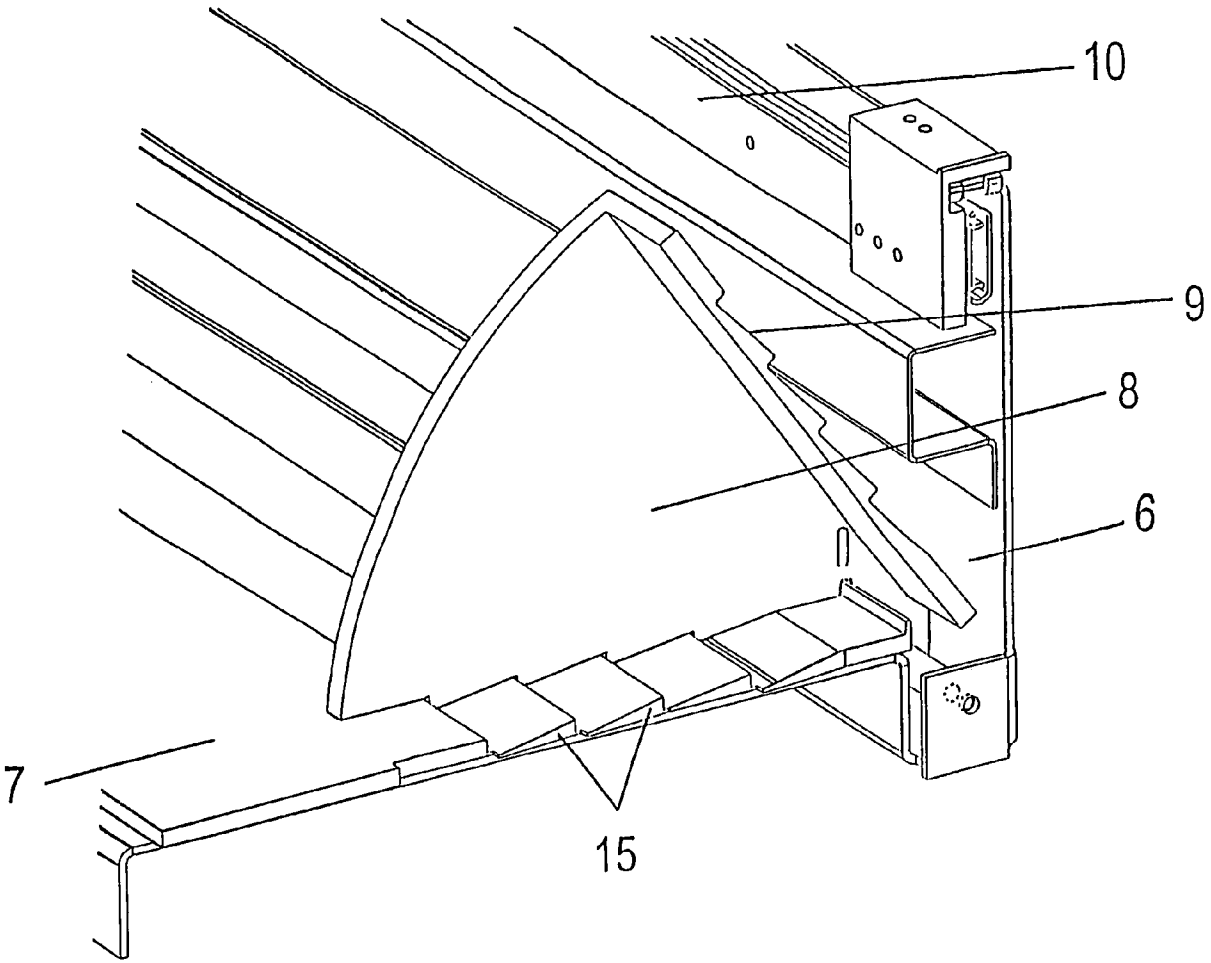
FIG. 4 shows an enlarged illustration of the pile support in the pile compartment.
Figure 5:
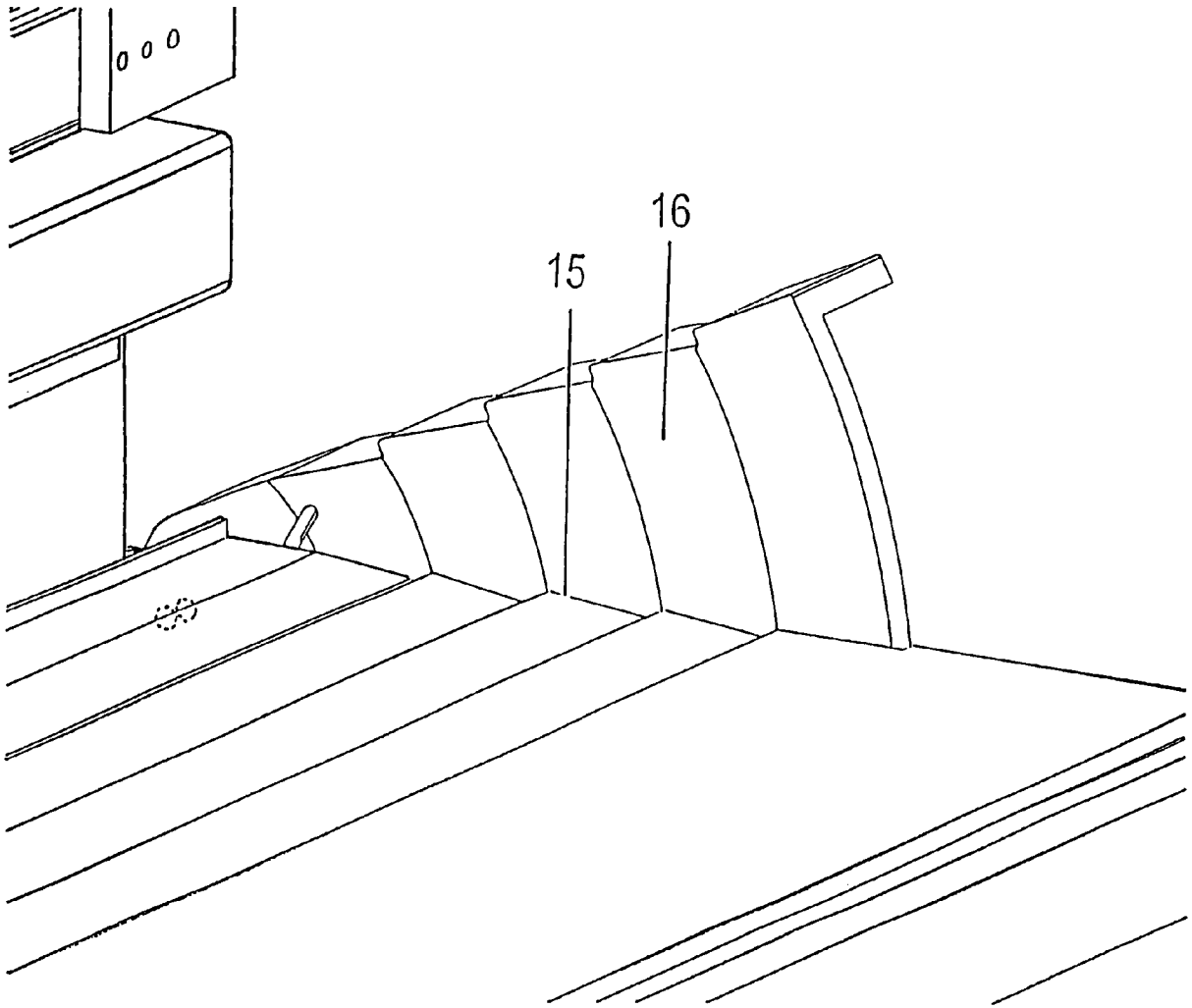
FIG. 5 shows a partial illustration of the pile compartment with the pile support pivoted partly down and a view of the profiled side.

As can be seen in FIG. 1, the pile bottom 7 is designed to be profiled in sawtooth form, the sawtooth flanks running parallel to the pile wall 6 and the steep flanks facing the pile wall 6. On its underside sliding on the pile bottom 7, the pile support 8 has the same profiling (FIG. 4), so that the two profiles intermesh. As a result, no thin and flexible postal articles 1 can slip between pile bottom 7 and pile support 8, and bouncing or sliding back from the pile wall 6 is largely avoided. In order to have sufficient space for the pivoting joint, the pile wall 6 has a set-back part in this lower region.

Figure 2:
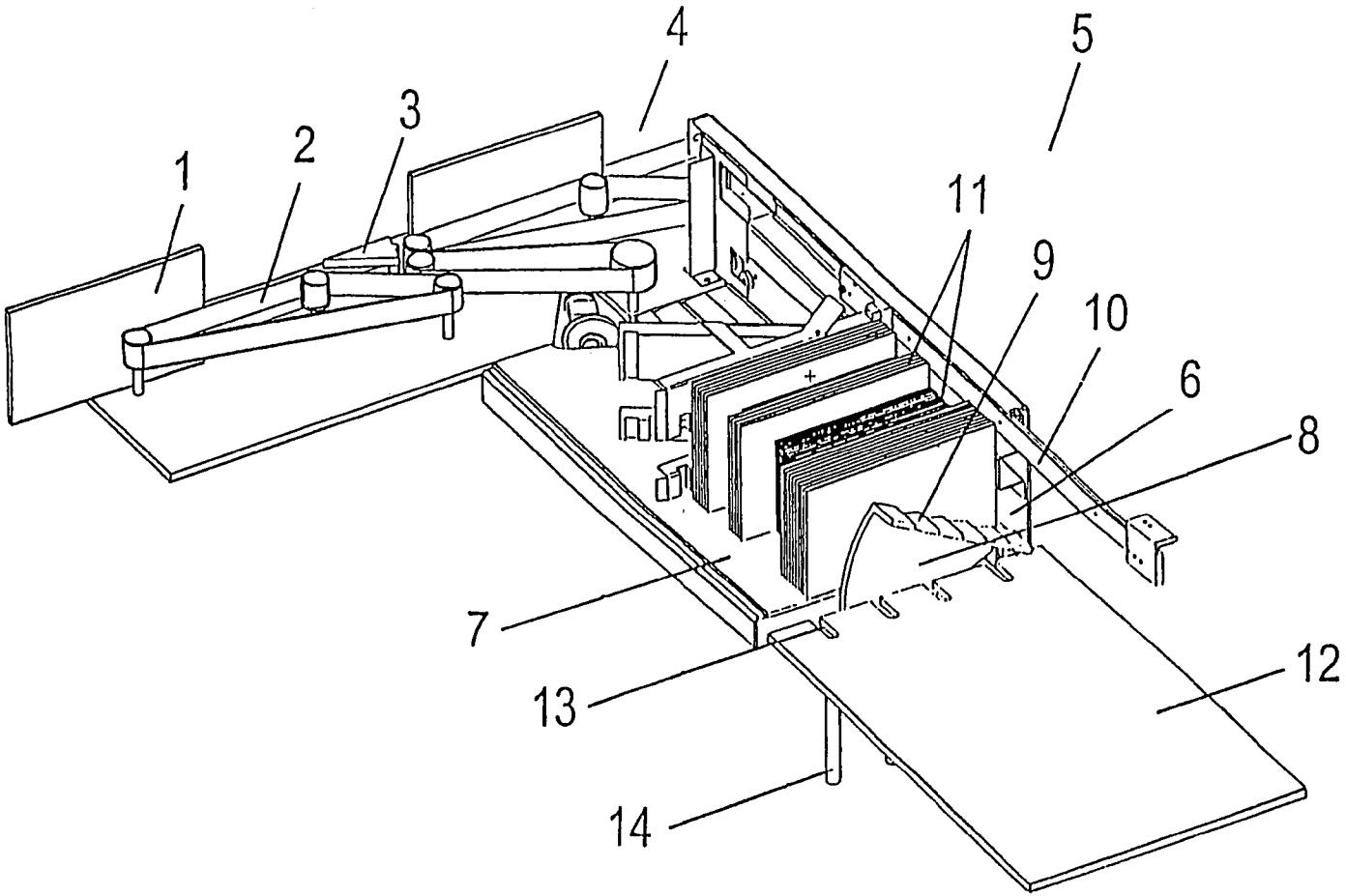
FIG. 2 shows the perspective illustration of a pile compartment, the end of the pile being located at the end of the pile compartment and the pile support having been pivoted partly downward.
Figure 3:
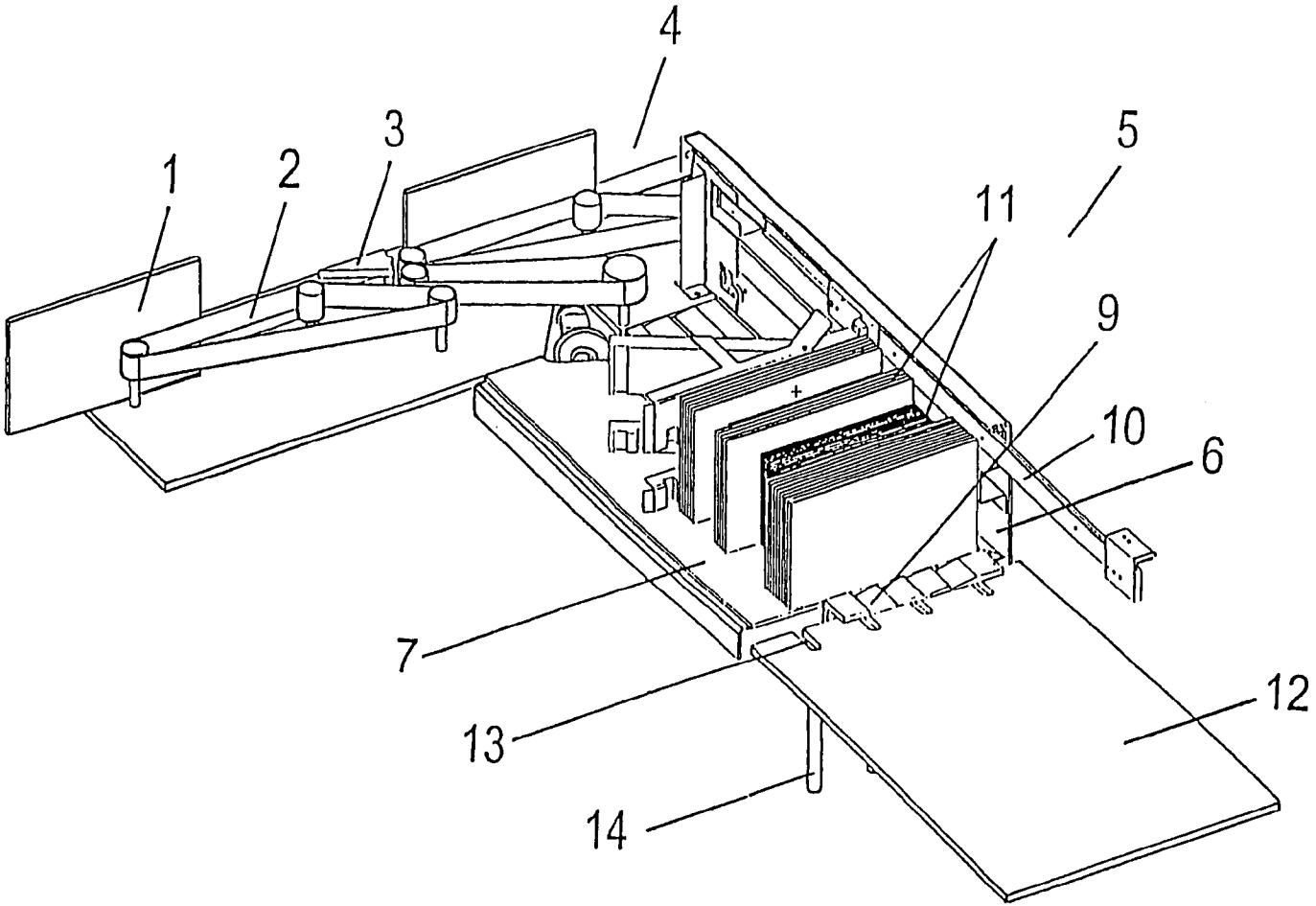
FIG. 3 shows a perspective illustration of a pile compartment corresponding to FIG. 2, the pile support having been pivoted completely downward.

During piling, the movement component of the postal articles 1 oriented along the pile wall 6 generates a force which displaces the pile support 8 away from the piling point, counter to the spring force. Once the pile 11 with the pile support 8 has reached the end of the pile compartment 5, either because the pile 11 is appropriately large or because the pile 11 held by the piling device 4 and the pile support 8 has been displaced accordingly by moving the piling device 4 with the aid of a thrust rod 10 connected to the latter, the pile support 8 is pivoted down in accordance with FIGS. 2 and 3, in order to be able to displace the pile 11 onto a following supporting surface 12. In order that the postal articles 1 from the pile 11 do not fall into the gap between pile bottom 7 and supporting surface 12, the pile support 8 has at its upper edge a part 9 which, in the lower end position, is aligned approximately parallel to the pile bottom 7 and, when the pile support 8 is pivoted completely down, bridges the gap, overlapping the supporting surface 12. Since thin postal articles 1 could also slip between pile bottom 7 and pile support 8, both the terminating edge 15 of the pile bottom 7 in the piling direction and that surface 16 of the pile support 8 which faces the terminating edge 15 during pivoting are profiled in such a way that they intermesh. The profile is likewise of sawtooth form, the profile on the side of the pile support running in a circular arc because of the pivoting movement.

The postal articles 1 would therefore have to run with their narrow sides in this sawtooth profile in order to get between the edge of the pile bottom and the pile support 8, but this does not happen because of their inherent stiffness. Before the pile support 8 is pivoted downward at the end of the pile compartment 5, an external supporting mechanism, not illustrated, is moved beside the stack support 8. When the stack support is pivoted down, the supporting mechanism takes over the pile 11 and then moves onward under control as the pile 11 is moved further. Once all the postal articles 1 from the pile 11 are located on the supporting surface 12, supporting fingers 14 are moved upward through the cutouts 13 and then support the pile 11, so that the piling device 4 can be brought into the initial position again.

The invention claimed is:

1. A pile compartment for flat postal articles in an upright position, comprising a pile bottom and a pile wall perpendicular thereto, on which the postal articles rest in the pile compartment, and having a pile support which can be displaced along the pile wall in an approximately horizontal piling direction, holding the pile, the pile bottom being at least partly provided with a bottom profile and the pile support being designed such that it meshes with the bottom profile via its surface sliding on the pile bottom, and wherein that the pile support can be lowered downward into the plane of the pile bottom at the end of the pile compartment, in such a way that it forms a bridge over a gap between the downstream terminating edge of the pile bottom and the upstream edge of a supporting surface which follows on downstream for the pile.

2. The pile compartment according to claim 1, wherein the pile support can be pivoted downward in the piling direction into the plane of the pile bottom at the end of the pile compartment.

3. The pile compartment according to claim 1, wherein the pile support that can be lowered is moved vertically after the pile bottom and, at its upper edge, has a part aligned approximately parallel to the pile bottom when it is lowered, in order to bridge the gap between the pile bottom and the following supporting surface, in that the terminating edge of the pile bottom located in the piling direction is also profiled, and the surface of the pile support which faces the profiled terminating edge of the pile bottom as it is moved vertically is profiled in such a way that it meshes with the profiled terminating edge of the pile bottom as it moves down.

4. The pile compartment according to claim 3, wherein the pile support can be pivoted perpendicularly with respect to the piling direction in order to move vertically in the plane of the pile bottom.

5. The pile compartment according to claim 1, wherein the pile bottom has a sawtooth profile, the steep flanks being oriented toward the pile wall.

6. The pile compartment according to claim 3, characterized in that the surface of that part of the pile support which is aligned approximately parallel to the pile bottom and on which the postal articles of the pile slide has the same surface profile as the pile bottom.

* * * * *